US007523915B2

(12) United States Patent
Halpin et al.

(10) Patent No.: US 7,523,915 B2
(45) Date of Patent: Apr. 28, 2009

(54) ICE SKEET MOLD

(76) Inventors: Chad P Halpin, 6121 Atkins Dr., Troy, MI (US) 48085; Sean P Halpin, 6121 Atkins Dr., Troy, MI (US) 48085

( * ) Notice: Subject to any disclaimer, the term of this patent is extended or adjusted under 35 U.S.C. 154(b) by 338 days.

(21) Appl. No.: 11/522,248

(22) Filed: Sep. 15, 2006

(65) Prior Publication Data

US 2008/0066728 A1 Mar. 20, 2008

(51) Int. Cl.
*F25C 1/22* (2006.01)

(52) U.S. Cl. ..... 249/168; 249/160; 425/451.9

(58) Field of Classification Search ..... 249/160, 249/168, 117; 425/451.9, 470
See application file for complete search history.

(56) References Cited

U.S. PATENT DOCUMENTS

| | | | | |
|---|---|---|---|---|
| 1,186,098 | A | | 6/1916 | Horst |
| 1,607,874 | A | | 11/1926 | Darton |
| 2,124,738 | A | | 7/1938 | Johnsen |
| 2,961,850 | A | | 11/1960 | Tupper |
| 3,421,729 | A | * | 1/1969 | Higginson ..... 249/117 |
| 3,431,598 | A | * | 3/1969 | Lueddeke et al. ..... 425/86 |
| 3,537,438 | A | | 11/1970 | Reed |
| 3,587,144 | A | * | 6/1971 | Mechling ..... 249/66.1 |
| 3,901,208 | A | | 8/1975 | Laporte et al. |
| 4,076,004 | A | | 2/1978 | Huelskamp |
| 4,147,324 | A | | 4/1979 | Walter |
| 4,222,361 | A | | 9/1980 | Jackson et al. |
| 4,920,762 | A | | 5/1990 | Beckstead et al. |
| 5,316,313 | A | | 5/1994 | Moore |
| 5,389,142 | A | | 2/1995 | Moore |
| 5,397,132 | A | | 3/1995 | Maryska |
| 5,649,707 | A | | 7/1997 | Brander et al. |
| 5,788,243 | A | | 8/1998 | Harshaw et al. |
| 2002/0060428 | A1 | | 5/2002 | Warren |

OTHER PUBLICATIONS 12 page printout from www.ecotargets.com dated Jul. 19, 2005.

* cited by examiner

*Primary Examiner*—James Mackey
(74) *Attorney, Agent, or Firm*—Harness, Dickey & Pierce, P.L.C.

(57) ABSTRACT

Various components useful in the sport of target shooting are disclosed herein. These components include a mold assembly for fabrication of a frozen water-based skeet, a skeet design particularly suited for fabrication from a frozen water-based liquid, and a hand-held skeet thrower for manually launching skeet. These components have utility individually or maybe combined to form a kit.

10 Claims, 6 Drawing Sheets

218'
222'
221'
220'
222
218
220

XIX
XX
XIV
XV
244
214
246
216
24
210
238
232
234
236
218
226
212
225
224
230
228
240

ICE SKEET MOLD

FIELD

The present disclosure relates to target shooting, and more particularly to a mold assembly for fabricating skeet, a skeet configuration particularly suitable for fabrication with a water-based liquid, and a hand-held skeet thrower.

BACKGROUND

The statements in this section merely provide background information related to the present disclosure and may not constitute prior art.

There are many avid sportsmen which enjoy target shooting, whether for honing their accuracy in preparation for hunting season or the enjoyment of target sports itself. In this sport, saucer-shaped targets are launched from a manual or automated thrower such that they fly or roll out in front of a shooter. The shooter then attempts to hit the target passing by with a round from a shot gun. The target may be presented at various angles with respect to its travel so as to simulate any of a number of hunted animals.

Historically, these targets, also known as skeet clays pigeons, have been fabricated from a mixture of cool tar ("pitch") and limestone powder. When left to degrade in the environment, these targets have the potential of releasing hazardous substances. Specifically, the pitch dust resulting in the disintegration of the target has the potential to infiltrate into the water and through the plants, as well as being ingested by animals and humans. Likewise, larger pieces of the target which disintegrate more slowly accumulate and remain within the environment.

There have been efforts to arrive at more environmentally-safe targets by utilizing naturally occurring substances such as calcium-based compounds or alternately silica, sand or clay based materials. Likewise, there have been efforts to fabricate such targets out of biodegradable or bio-friendly materials such as fertilizer, bird feed and even water. As such, these targets address many of the environmental concerns associated with more conventional clay pigeons. However, improvements for an efficient and repeatable means for fabricating such environmentally-safe target remain.

SUMMARY

As described in more detail herein, a skeet system which includes a mold assembly is provided for fabricating a target fabricated from a frozen water-based liquid, i.e. an ice skeet. This disclosure further includes a hand-held thrower which is particularly well suited for launching ice skeet, as well as conventional skeet.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figures 12, 13, 14, 15A, 15B:
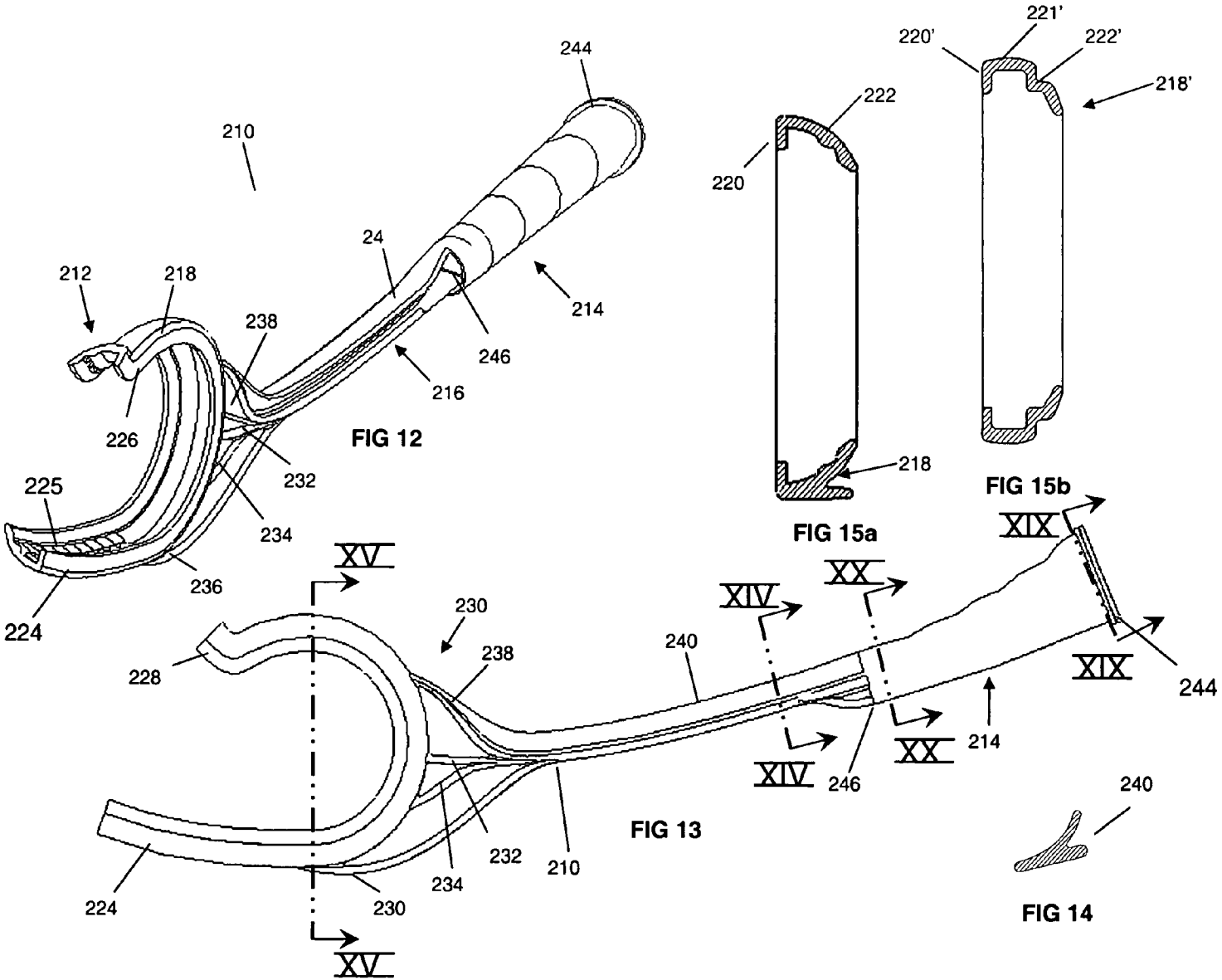
FIG. 12 is a perspective view of a skeet thrower suitable for launching skeet such as illustrated in FIG. 9.
FIG. 13 is a plan view of the skeet thrower illustrated in FIG. 12.
FIG. 14 is a cross sectional view taken along line XIV-XIV shown in FIG. 13.
Figure 17:
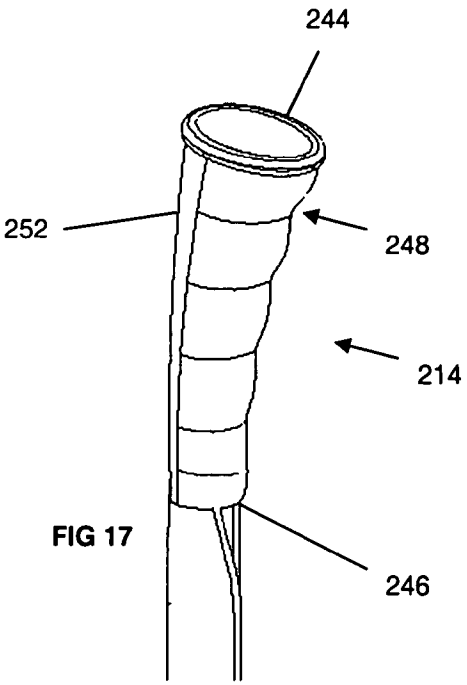
Figure 16:
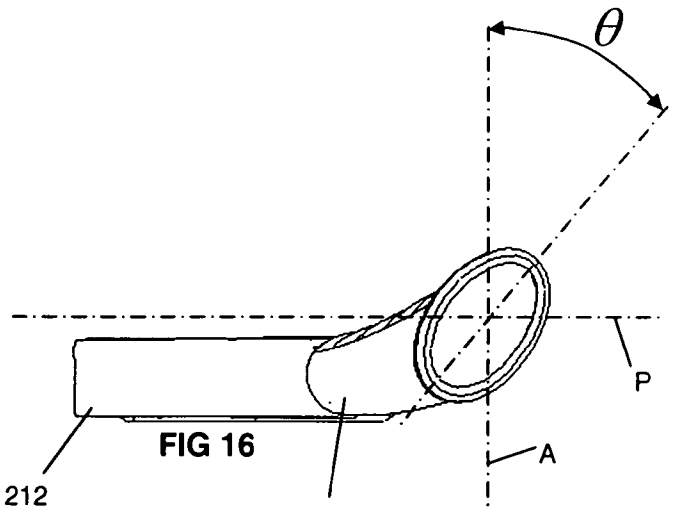
Figure 18:
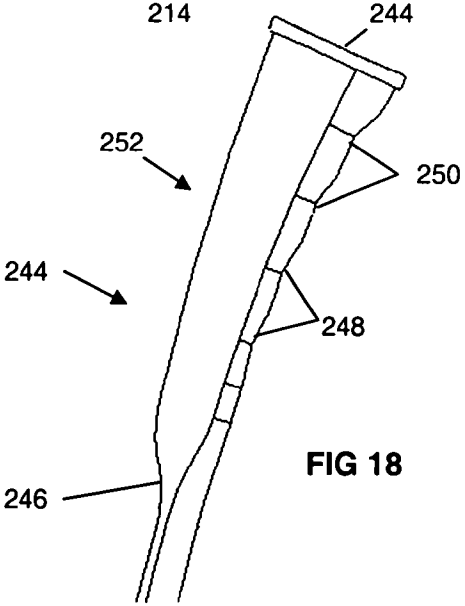

FIG. 15*a* is a cross sectional view taken along line XIV-XIV shown in FIG. 13;

FIG. 15*b* is an alternate embodiment showing the cross sectional configuration of a hand thrower similar to that illustrated in FIG. 12 suitable for throwing conventional clay targets;

FIG. 16 is an end view of the hand thrower illustrated in FIG. 12;

FIG. 17 is a detail of the finger region formed on the grip portion of the handle for the hand thrower illustrated in FIG. 12; and FIG. 18 is a detail illustrating a palm region of the grip portion of the hand thrower illustrated in FIG. 12.

Figure 19:
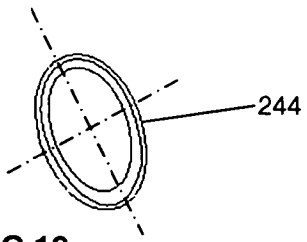
Figure 20:
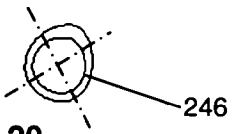

FIG. 19 is a cross-section of the handle butt taken along line IXX-IXX shown in FIG. 13; and FIG. 20 is a cross-section of the handle top taken along line XX-XX shown in FIG. 13.

DETAILED DESCRIPTION

The following description is merely exemplary in nature and is not intended to limit the present disclosure, application, or uses.

The present disclosure provides a mold assembly for fabricating skeet from a frozen water-based liquid and a hand-held thrower for launching such skeet. Furthermore, this disclosure includes a description of the configuration of a skeet formed in the mold assembly. Accordingly, one skilled in the art will recognize that this disclosure, taken as a whole may provide a kit of components which enable a sportsman to fabricate and launch ice skeet which is inexpensive and thus affordable, as well as biodegradable and thus environmentally-safe. The following description will be broken down into three aspects: (1) the mold assembly; (2) the skeet; and (3) the hand-held launcher.

Turning first to FIGS. 1-8, a mold assembly 10 is illustrated which includes a lower mold 12 and a upper mold 14 which can be releasably secured together to define a mold cavity 16. The mold assembly 10 includes a rotational locking mechanism 18 which allows the upper mold 14 to be releasably secured to the lower mold 12 in a quick and efficient matter. The mold assembly 10 further includes a stacking structure 20 which allow multiple mold assemblies to be stacked and placed into a freezer in a stable and compact arrangement. The mold assembly 10 includes various design and structural features for controlling the flow of water and air during the molding process and facilitate release of the skeet which yields a nearly defect free target.

Figure 4:
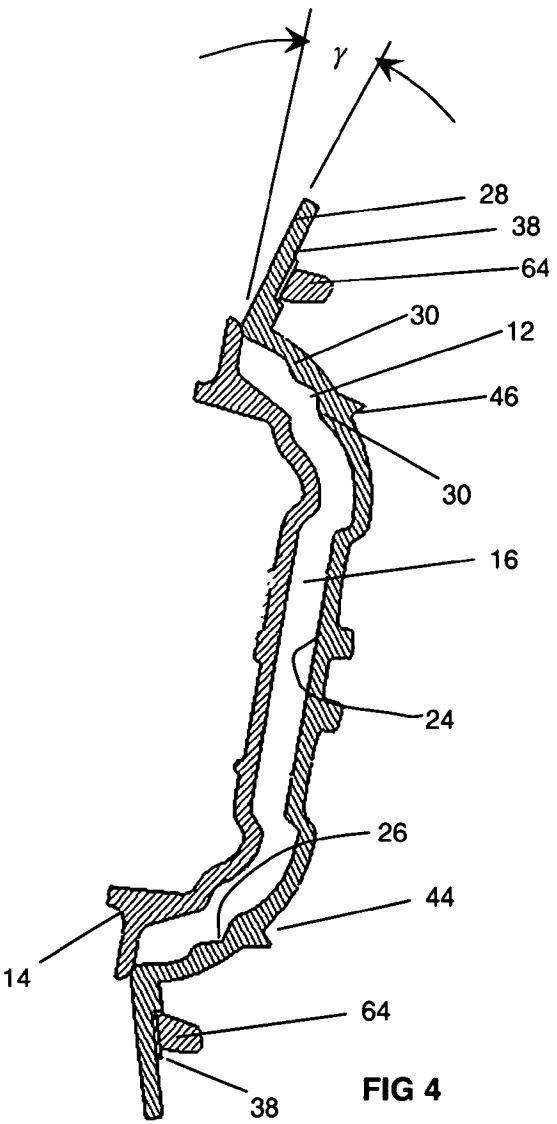
FIG. 4 is a cross-sectional view taken along line IV-IV shown in FIG. 3.
Figure 5:
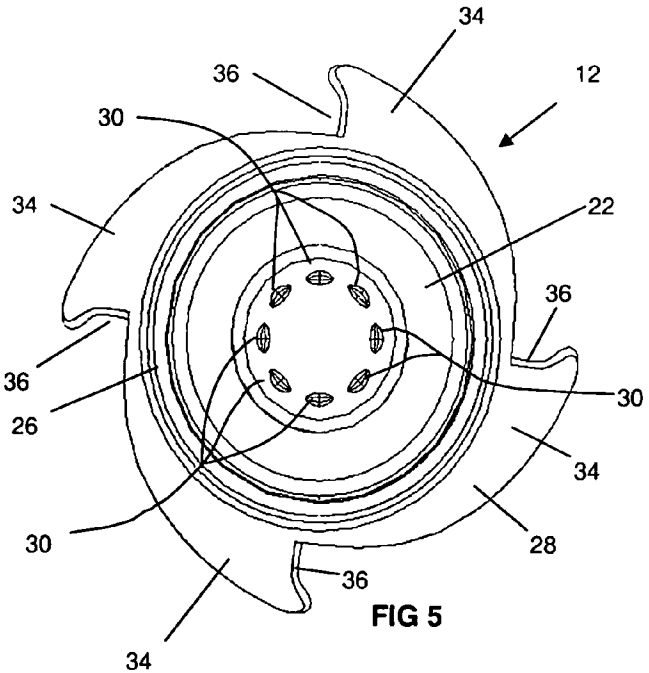
FIG. 5 is a plan view of the lower mold of the mold assembly shown in FIG. 1.
Figure 6:
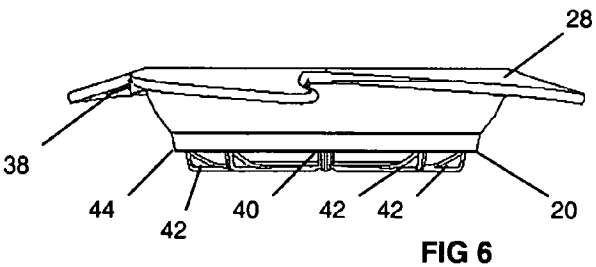
FIG. 6 is a side elevational view of the lower mold illustrated in FIG. 5.

With specific reference now to FIGS. 2, and 4-6, the lower mold 12 is described in further detail. Lower mold 12 includes a well 22 which defines the bottom part of the mold cavity 16. The well 22 is circular in configuration and includes a bottom wall 24, a side wall 26 extend upwardly and terminating at an upper flange 28. The bottom wall 24 includes a series of protuberances 30 which extend upwardly in well 22 so as to break up the relatively large flat surface defined by the bottom wall 24. The side wall 26 is defined by a generally curved radius (as best seen in FIG. 4) with a pair of reliefs 30 extending therefrom. In this manner, the side wall is slightly stepped to provide improved structural integrity for skeet formed in mold assembly 10. The upper flange 28 of lower mold 12 is angled slightly downward as indicated by $\alpha$ in FIG. 4 towards the bottom wall 24. As presently preferred, upper flange 28 is angled at about 20° to promote drainage of water away from the perimeter of the mold cavity 16, and thus forming a clean edge on a skeet formed therein. Upper flanges 28 are defined by a series of arcuate sections 34 as best seen in FIG. 5 which terminate at an edge 36. A ramp 38 is formed on the bottom surface of arcuate section 34 at edge 36. These ramps 38 cooperate with fingers 62 extending from the upper mold 14 to provide rotational locking mechanism 18. The outer surface 40 of bottom wall 24 on the side (opposite mold cavity 16) has a series of radial rib portions 42 extending therefrom and a circumferential channel 44 which cooperates with complimentary features 66, 68 formed on the upper mold 14 to allow multiple mold assemblies 10 to be arranged in a stack relationship.

Figure 2:
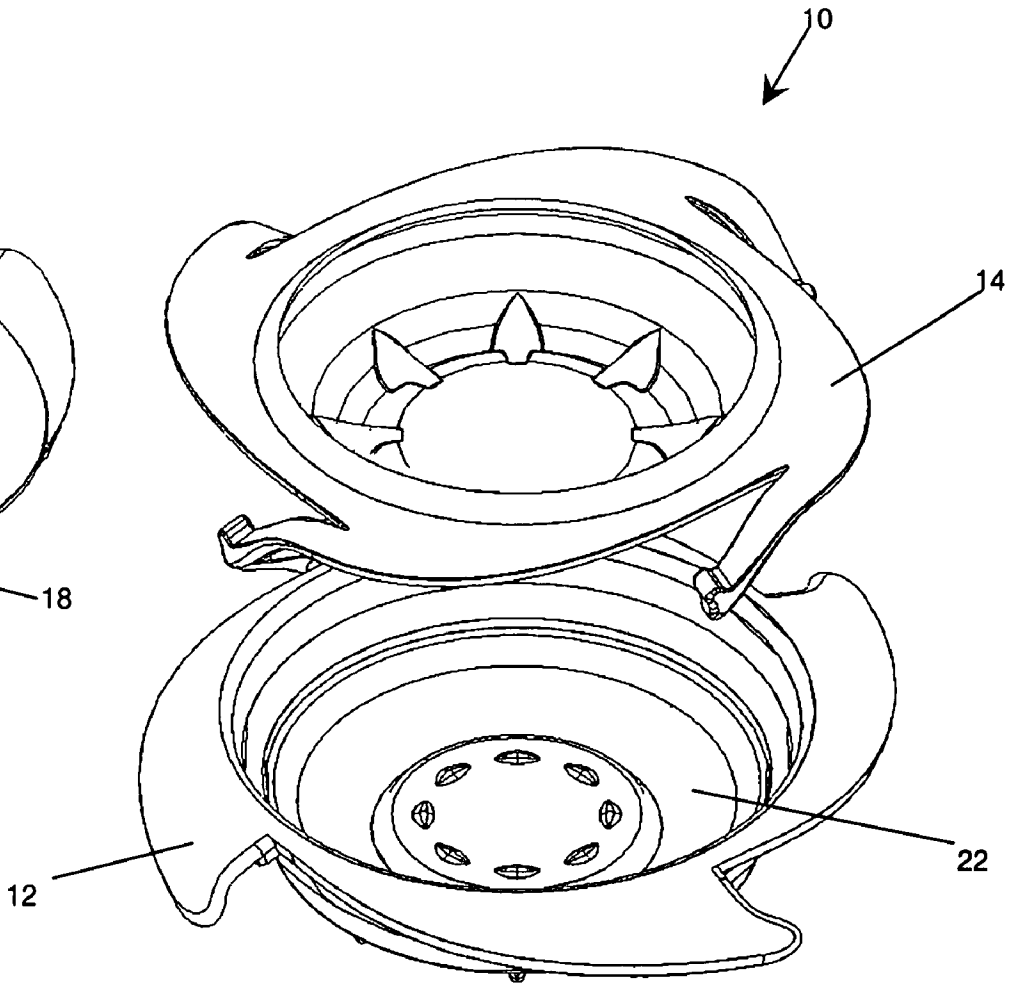
FIG. 2 is an exploded view of the mold assembly in FIG. 1.
Figure 7:
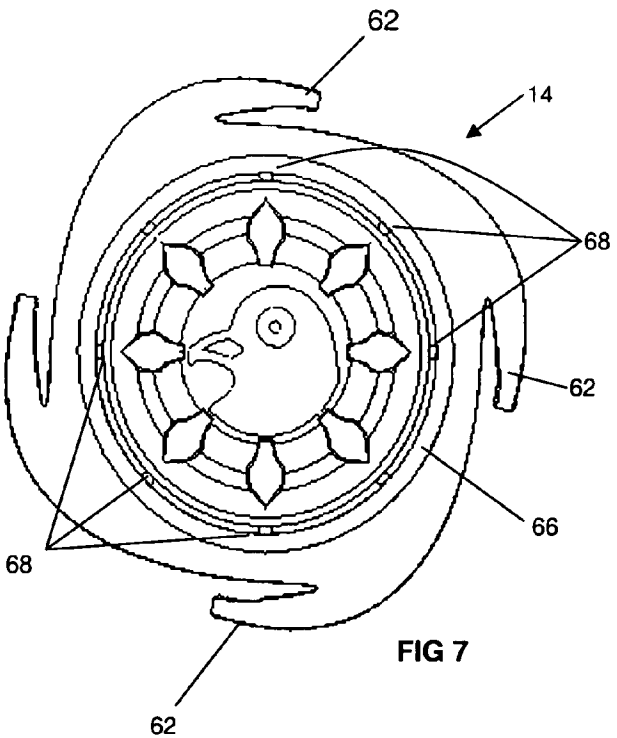
FIG. 7 is a plan view of the upper mold of the mold assembly illustrated in FIG. 1.
Figure 8:
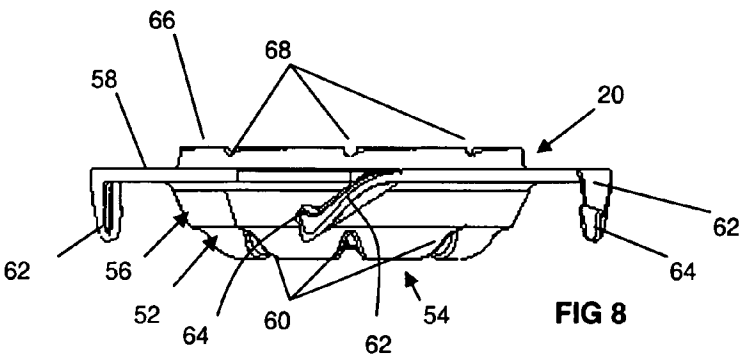
FIG. 8 is side elevational view of the mold assembly illustrated in FIG. 7.

With reference now to FIGS. 2, 7 and 8, the upper mold 14 will be further described. Upper mold 14 includes a dish 52 which extends into well 22 for defining the mold cavity 16. The dish 52 includes a top wall 54, a side wall 56 and a flange 58. The top wall 54 has a series of radially extending channels 60 which terminate at side wall 56. These channels 60 promote the flow of water within the mold cavity 16 when the upper and lower molds 12, 14 are assembled to ensure that air bubbles are not trapped within the cavity 16. The side wall 56 is a generally flat surface angularly oriented between the top wall 54 to flange 58. The flange 58 is generally flat and includes a series of fingers 62 extending tangentially. Fingers 62 angle generally downward and terminate at lobe 64.

Figure 1:
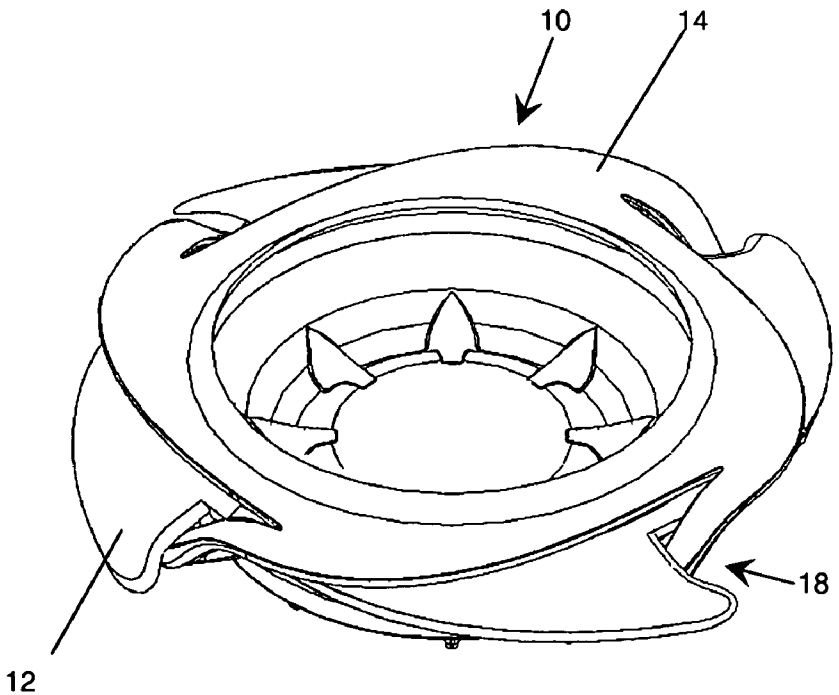
FIG. 1 is a perspective view of a mold assembly for fabricating an skeet.

The fingers 62 cooperate with the arcuate sections 34 formed on lower mold 12 to provide a rotational locking mechanism 18. Specifically, the upper mold 14 is positioned on top of lower mold 12 with the fingers 62 located in front of edge 36. Once in this relationship, the upper mold 14 can be rotated in the clockwise direction (as shown in FIG. 1) such that the fingers 62 extend beneath the arcuate section 34 and the lobes 64 capture the ramps 38 formed along edge 36. Counter rotation of the upper mold 14 relative to the lower mold 12 releases the mold assembly 10.

As best seen in FIG. 4, the flange portion 28 of lower mold 12 and the flange portion of upper mold 14 come together in a tight fitting arrangement such that the mold cavity 16 is a tightly defined close cavity. In this manner, the perimeter of skeet formed in the mold cavity 16 is clearly defined. The upper mold 14 includes a rim 66 extending upwardly from flange 58. The rim 66 has a series of indentations 68 formed therein. Rim 66 is sized to fit within the channel 44 formed in the outer surface 40 of the lower mold 12. The indents 68 are configured to receive the radially ribs 42 formed on the outer surface 40 of a lower mold 12. In this manner, ribs 42, channel 44, rims 66 and indents 68 define the stacking structure 20 which allows multiple mold assemblies to be arranged in a stacked configuration.

Having described the structure of mold assembly 10, various functions performed by these structures will be described in conjunction with the process of fabricating skeet. Initially, the lower mold 12 is placed on a flat surface. Water or a water-based liquid is dispensed into the well 22. In this regard, the reliefs 32 in the side wall 26 can function as a fill line indicator to prevent over filling of the well 22.

Figure 3:
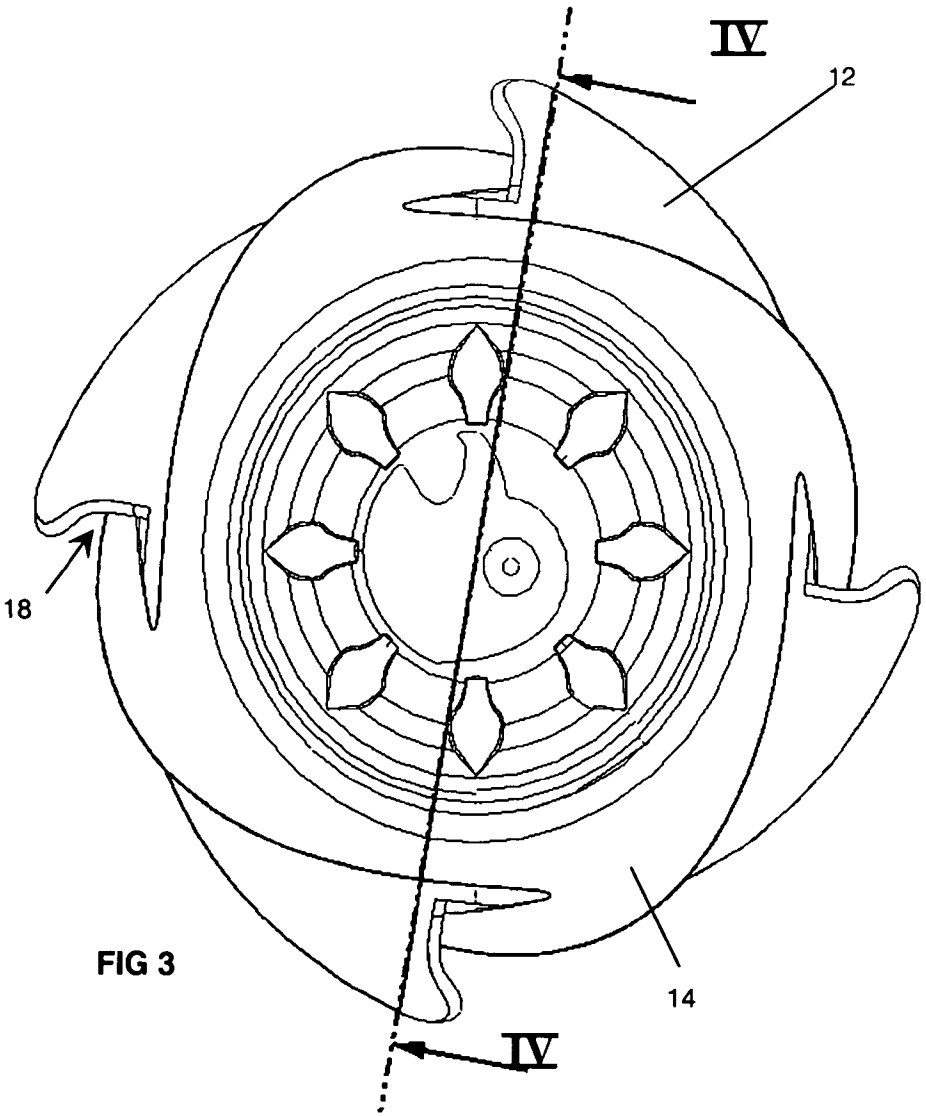
FIG. 3 is a plan view of the mold assembly in FIG. 1.

Next, the upper mold 14 is placed on top of the lower mold 12 such that the fingers 62 are located adjacent the arcuate sections 34. As the upper mold 14 is so placed, the dish 52 displaces the liquid from within the well 22. The channels 60 formed in the upper mold 14 direct air radially outward such that it escapes from the mold cavity 16 prior to closure. Once properly placed on the lower mold 12, the upper mold 14 is rotated clockwise (as shown in FIG. 1-3) such that the fingers 62 extend beneath the arcuate surface 34 as heretofore described. In the closed and locked position, the mold cavity 16 defines a tightly confined closed volume. Any excess liquid which is expelled from the mold cavity 16 drains downward along flanges 28. The filled mold assembly 10 may be placed into a freezer to allow the liquid therein to solidify.

Once the liquid in the mold assembly 10 has frozen, the skeet formed therein may be removed. In this regard, a reverse of the operation here before described is performed to disassemble the mold assembly 10 and remove the skeet formed therein. During this operation, the channels 60 formed in the upper mold 14 drivingly rotate the skeet formed in the mold assembly 10. As the upper mold 14 and skeet counter-rotate, the protuberances 30 formed on bottom wall 24 facilitate the release of the skeet from the lower mold 12. Specifically, the ramped profile of the protuberances 30 cause the skeet to cam away from the bottom wall 24 so that the skeet readily releases from the lower mold 12. During counter rotation, the fingers 62 release from the ramps 38 to unlock the mold assembly. Once disassembled, the skeet may be removed from the upper mold 14 and the process repeated for fabricating additional skeet.

Once skilled in the art will recognize that it is preferable for the mold assembly to have some elastic characteristic for accommodating the expansion of the water as it changes from a liquid state to a sold state. In this regard, the mold assembly 10 is preferably that the mold cavity be allowed to expand approximately 10% by volume. To this end, molds 12, 14 may be constructed from a polymeric material such polypropylene or similar material that is suitable for the thermal conditions and cycling to which the mold assembly 10 will be exposed. Furthermore, it has been found that this material yields a mold assembly with sufficient surface quality to facilitate removal of the skeet formed therein. One skilled in the art will recognized that a surface treatment or release agent may also be disposed on the interior of the lower and upper mold 12, 14 which define the mold cavity 16.

Figure 10:
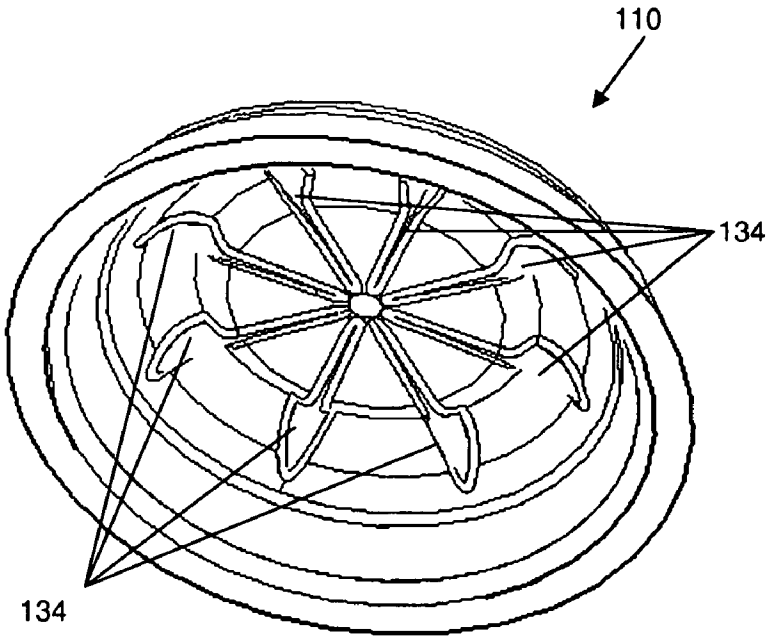
FIG. 10 is a bottom perspective view of the skeet illustrated in FIG. 9.
Figure 9:
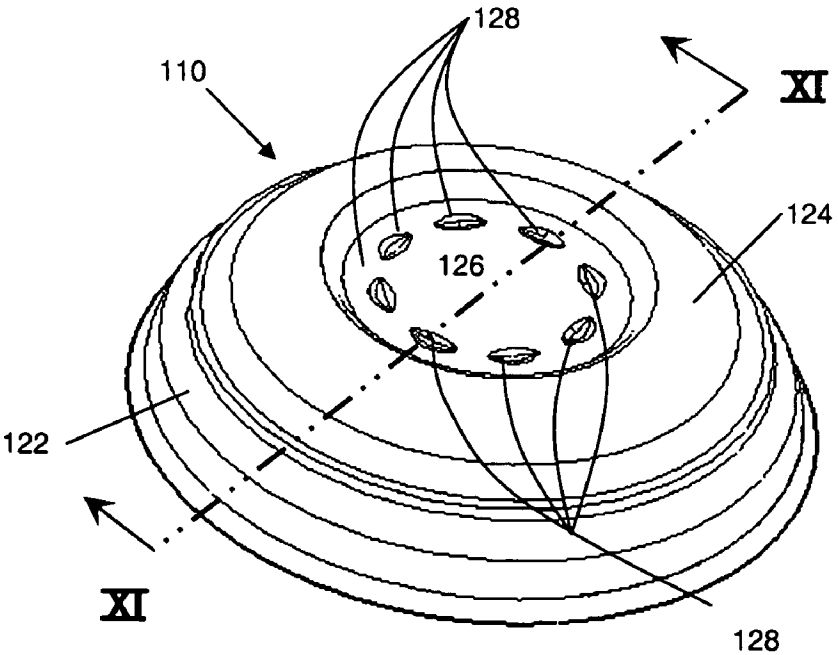
FIG. 9 is a top perspective view of an skeet fabricated from the mold assembly illustrated in FIG. 1.
Figure 11:
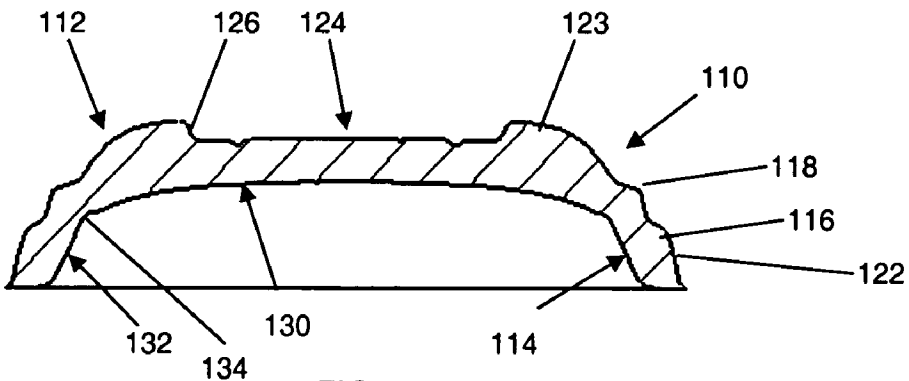
FIG. 11 is a cross sectional view of the skeet taken along line XI-XI shown in FIG. 9.

With reference now to FIGS. 9-11, a preferred embodiment of an shooting target or skeet, generally identified by reference number 110 is illustrated. Skeet 110 is configured in a disc-like shape having a generally convex outer surface 112 and a generally convex inner surface 114. A series of circumferential ridges 116, 118, 120 are formed on the outer surface 112. Specifically, ridges 116, 118 are formed in the side wall 122, whereas ridge 120 is formed on the top wall 124. Ridges 116, 118, 120 enhance the aerodynamic stability of the skeet 110 when it is projected into the air during flight, and further served to increase the structural integrity of the skeet 110. Ridge 120 and top wall 124 form a generally dished region 126. The flat portion of the dish region 126 have a series of dimples 128 formed therein. As noted above, these dimples are formed by the protuberances 30 in the upper mold 14 and facilitate release of the skeet therefrom. In flight, the dimples 128 function to manipulate the boundary layer of air flowing over the skeet 110. In this way, a more turbulent flow around the skeet 110 is generated such that a separation from the boundary layer is delayed resulting in a reduction in the pressure-induced drag during flight.

The inner surface 114 has a large-radius bottom wall 130 which transitions to a angularly-oriented side wall 132 as best seen in FIG. 11, the transition point 134 between bottom wall 130 and side wall 132 occurs at ridge 118 to provide for sufficient wall thickness of the skeet 110 for maintaining its structural integrity. In addition, bottom wall 130 has a series of radially-extending ribs 134 formed therein. As previously discussed, these ribs function to operably couple the skeet 110 to upper mold 14 to allow for co-rotation during removal of the skeet 110 from the mold assembly 10. Radial ribs 134 further provide structural reinforcement to skeet 110.

As previously discussed, the skeet 110 is preferably formed by freezing water or a water-based liquid into the configuration heretofore described. In this regard, it has been found that mixing a coloring additive in the water or water-based liquid enhances the visibility of skeet 110. In this regard, it has been found that commercially-availably flavored gelatin mixtures dilute the gelatin mixture by a ratio of [insert jello to water ratio] are suitable for the fabrication of skeet in accordance herewith.

Alternately, a coloring agent which is non toxic and environmentally-friendly maybe applied to the outer surface of the skeet 110 after it is removed from the mold, for the purposes of making the target more visible to a shooter.

Referring now to FIGS. 12-17, a manual or hand-held thrower 210 for skeet 110 is illustrated. The hand thrower 210 includes a head 212 and a grip 214 interconnected by a flexible body 216. As presently preferred, the hand thrower 210 is a unitary injection-molded component.

The head 212 of hand thrower 210 includes a generally U-shaped rim 218 having a lower flange 220 and a contoured side wall 222. As illustrated in the embodiment of FIG. 15*a*, the rim 218 cross-section is shaped to conform to the outer side wall surface of a skeet 110 disposed therein. This configuration is particularly well suited for launching ice skeet. Alternately, the rim 218' having a lower flange 220', a vertical side wall 221' and a contoured side wall 222' as shown in FIG. 15*b* for launching conventional "clay" skeet. The rim 218 further includes a finger portion 224 and a thumb portion 226 which define the generally U-shape. As best seen in FIG. 13, finger portion 224 is longer than thumb portion 226 such that a target launched from hand thrower 110 maintains contact with the finger portion 224 after it is released from thumb portion 226. To this end, the inner surface 225 of the finger portion 224 has a roughened texture to increase friction and promote spin of skeet launched from hand-held thrower 210. The inner surface 225 may be grained to an equivalent of 80-grit sandpaper. The inner surface may also be provided with ramps to define a series of bumps angled toward the end of fingers 224. The thumb portion 226 includes a tip 228 which extends away from the generally U-shape opening defined by rim 218. The tip 228 of thumb portion 226 thus provides a entry region for inserting a skeet into the hand thrower 210.

The body 216 includes a neck 230 having a series of flared ribs coupled to the rim 218. A medial rib 232 is generally centrally located with respect to the head 212. A pair of lateral ribs 234, 236 are coupled to rim 218 along a finger portion 224. A single lateral rib 238 is coupled to the thumb portion 226 of rim 218. This asymmetric configuration facilitates proper release of skeet from the hand thrower 210. Specifically, lateral ribs 234, 236 provide additional stiffness to the finger portion 224, whereas the single lateral rib 238 coupled to thumb portion 226 enables sufficient flexing of the head portion during insertion of a target into hand thrower 210.

Body 226 includes a beam portion 240 extending between neck portion 230 and grip 214. The beam portion 240 has a generally inverted V-shaped cross section as best seen in FIG. 14. The configuration of beam portion 240 provides sufficient flexibility such that potential energy stored in the body 216 during the throwing motion is transferred into kinetic energy for the flight of the skeet 110 once release.

The grip 214 of hand thrower 210 is configured in a comfortable, ergonomic design. Specifically, the grip 214 is generally shaped in the form of an elliptical frustum which tapers from the handle butt 244 to the handle top 246. With reference to FIG. 19, a handle butt 244 having a circumference of about 5.5" and a ratio of the major axis to the minor axis is in the range of 1.5 to 1.75 is presently preferred. With reference to FIG. 20, a handle top 246 having a circumference of about 3.25" and ratio of the major axis to the minor axis is in the range of 0.75 to 1.0 is presently preferred. The ratio of the major axis at the handle butt 244 to the major axis at the handle top 246 is in the range of 2.0 to 2.25 and preferably about 2.125. With reference now to FIG. 16, grip 214 is angularly oriented with respect to an axis A normal to a plane P parallel to the head 212 to provide proper biomechanical positioning of the hand thrower during use. Specifically, an angular offset $\hat{-}$ is in the range of 35° to 55°, and more preferably 45° is suitable for this application.

The grip 214 has a finger region 248 with a series of indentations 250 sized to comfortably accommodate human fingers. The grip 214 also includes a palm portion 252 formed on the grip 214 opposite the finger region 248. The finger region 248 and palm region 252 have a curved configuration in the side elevation as illustrated in FIGS. 13 and 17. As presently preferred, the radius of curvature of the finger region is about 20 percent smaller than the radius of curvature of the palm region. The finger region 248 and palm region 252 may also be provided with an in-molded rubberized material to provide enhanced comfort and gripping, thereby further improving the ergonomics of the handle. While the design of this handle has found particular utility in conjunction with a skeet hand thrower 210, its comfort and ease of grip suggest that applications outside of the hand thrower 210 are recognized. Such applications for the grip 214 include garden tools such as trowels, hand rakes, weeders, and the like, as well as home improvement tools such as scrapers, paint rollers, dust brooms, and the like.

What is claimed is:

1. A mold assembly for fabricating skeet comprising:

a first mold including a well region defined by a wall having a first flat portion and a first side portion, the first flat portion having at least one protuberance extending therefrom;

a second mold having a dished region defined by a wall having a second flat portion and a second side portion, the second flat portion having at least one radial channel formed therein;

a rotational locking mechanism including a plurality of flanges and a plurality of fingers for releasably securing the first and second molds together;

wherein the dished region and the well region define a closed mold cavity when the second mold is placed on top of the first mold, and the fingers engage the flanges when the second mold is rotated relative to the first mold to a locked position.

2. The mold assembly of claim 1 wherein the plurality of flanges extends from the well region of the first mold and the plurality of fingers extend from the dished region of the second mold.

3. The mold assembly of claim 2 wherein each of the fingers has a lobe formed thereon and each of the flanges has a ramp formed thereon, the fingers extending beneath the flanges such that the lobes capture the ramps in the locked position.

4. The mold assembly of claim 1 wherein the plurality of flanges slope away from an opening of the well region towards the first flat portion of the wall.

5. The mold assembly of claim 1 further comprising a stacking mechanism including a first stacking structure formed on the first mold on a side opposite the well region and a second stacking structure formed on the second mold opposite the dished region and configured to interlock with the first stacking structure.

6. The mold assembly of claim 5 wherein the stacking structures further comprise a circular channel formed in the first mold and a circular rim formed in the second mold and configured to be received within the circular channel.

7. The mold assembly of claim 6 wherein the stacking structures further comprise a radial rib formed in the first mold and an indentation formed in the circular rim of the second mold and configured to receive the radial rib.

8. The mold assembly of claim 1 wherein the well region and dished region are sufficiently compliant to allow a volume of water within the closed mold cavity to expand not more than about 10% during freezing.

9. The mold assembly of claim 8 wherein the first and second molds are made of a polymeric material.

10. A mold assembly for fabricating skeet comprising:

a first mold including a first flat portion having a plurality of protuberances formed thereon, a first side wall extending from the first flat portion and terminating at a first rim, a plurality of arcuate flanges extending radially from the first rim, the first flat portion the first side wall and the first rim defining a well region;

a second mold including a second flat portion having a plurality of radial channels formed therein, a second side wall extending from the second flat portion and a second rim, a plurality of fingers extending tangentially from the second rim, the second flat portion, the second side wall and the second rim defining a dished region;

a rotational locking mechanism including a ramp formed on an edge of each of said plurality of arcuate flanges and a lobe formed on an end of each of said plurality of fingers, said lobes engaging said ramps for releasably securing the first and second molds together;

wherein the dished region and the well region define a closed mold cavity when the second mold is placed on top of the first mold, and the fingers engage the flanges when the second mold is rotated relative to the first mold to a locked position.

* * * * *